US010870569B2

(12) United States Patent
Ye et al.

(10) Patent No.: US 10,870,569 B2
(45) Date of Patent: Dec. 22, 2020

(54) DISPENSER WITH ALCOHOL THROTTLE VALVE

(71) Applicant: NINGBO MAJOR DRAFT BEER EQUIPMENT CO., LTD, Ningbo (CN)

(72) Inventors: Xiaoyang Ye, Ningbo (CN); Bangcai Luo, Ningbo (CN)

(73) Assignee: NINGBO MAJOR DRAFT BEER EQUIPMENT CO., LTD, Ningbo (CN)

( * ) Notice: Subject to any disclaimer, the term of this patent is extended or adjusted under 35 U.S.C. 154(b) by 0 days.

(21) Appl. No.: 16/567,503

(22) Filed: Sep. 11, 2019

(65) Prior Publication Data

US 2020/0087136 A1 Mar. 19, 2020

(30) Foreign Application Priority Data

Sep. 14, 2018 (CN) ..... 2018 1 1072825
Sep. 14, 2018 (CN) ..... 2018 2 1504824 U

(51) Int. Cl.
*B67D 1/12* (2006.01)

(52) U.S. Cl.
CPC ..... *B67D 1/1279* (2013.01)

(58) Field of Classification Search
CPC ... B67D 1/0831; B67D 1/0437; B67D 1/1279
USPC ..... 222/400.7
See application file for complete search history.

(56) References Cited

U.S. PATENT DOCUMENTS 1,630,947 A * 5/1927 Jenks ..... B67D 1/0456 137/636
2,388,026 A * 10/1945 Ward ..... B67D 1/0425 137/630.22
2,899,170 A * 8/1959 Cornelius ..... B67D 1/1466 251/122
3,361,152 A * 1/1968 Akers ..... C07D 453/02 137/212
3,596,809 A * 8/1971 Taubenheim ..... B67D 1/0831 222/400.7
3,698,417 A * 10/1972 Smith ..... B67D 1/0802 137/212
4,350,270 A * 9/1982 Nezworski ..... B67D 1/0832 222/336
4,516,698 A * 5/1985 Cerrato ..... B67D 1/0829 222/341
5,690,136 A * 11/1997 Celli ..... B67D 1/0832 137/212

(Continued)

*Primary Examiner* — Vishal Pancholi
(74) *Attorney, Agent, or Firm* — Charles C. Achkar; Ostrolenk Faber LLP.

(57) ABSTRACT

A dispenser with an alcohol throttle valve includes a dispenser base, a head, an operation control device and a throttle valve. The dispenser base has a head socket hole formed at the middle of the dispenser base and matched with and movably connected to the head. The operation control device is matched with and connected to the dispenser base and the head. The head controls its head movement in the head socket hole of the dispenser base by the operation control device. The throttle valve is matched with and installed in the head and can adjust the liquid flow in the head. The alcohol output can be controlled by adjusting the liquid flow passing through the throttle valve, so that the dispenser has the function of controlling the alcohol output flow.

9 Claims, 6 Drawing Sheets

(56) References Cited

U.S. PATENT DOCUMENTS

| | | | | |
|---|---|---|---|---|
| 7,287,670 | B2 * | 10/2007 | Yoshida | B67D 3/0003 222/1 |
| 2008/0142553 | A1 * | 6/2008 | Lassen | B67D 1/0829 222/399 |
| 2015/0203342 | A1 * | 7/2015 | Witte | B67D 1/0831 220/495.06 |

* cited by examiner

DISPENSER WITH ALCOHOL THROTTLE VALVE

CROSS REFERENCE TO RELATED APPLICATIONS

The present application claims priority to China Application No. 201811072825.9 filed on Sep. 14, 2018 and China Application No. 201821504824.2 filed Sep. 14, 2018, the subject matter of each of which are incorporated herein by reference in their entirety.

FIELD OF INVENTION

The present disclosure relates to the field of a beer fresh-keeping keg, in particular to a dispenser with an alcohol throttle valve.

BACKGROUND OF INVENTION

Description of the Related Art

Draft beer is a beer processed with a microporous membrane filter, and ordinary beer is a beer processed with a high temperature pasteurization. Unlike bottled or keg beer processed with the high temperature pasteurization or beer on tap which has not been pasteurized, draft beer is a premium alcoholic beverage which is purely natural, free of pigment, preservative, sugar or any edible essence, and extremely rich in nutrition. Draft beer is a wonderful beverage in the beer kingdom and gains an increasingly proportion of the world's beer consumption, and it is also hailed as "Original beer juice". Draft beer, the premium alcoholic beverage is injected directly from the production line into a fully sealed stainless steel barrel, and carbon dioxide is filled into a draft beer machine for drinking, wherein the draft beer machine controls the beer at a temperature of 3~8 degrees C. When drinking, the draft beer is poured from the draft beer machine into a beer cup directly to prevent the beer from contacting air, so that the beer is fresher, purer, thicker, richer in foam, more refreshing, and full of aftertaste. The draft beer contains yeast which as the effects of promoting the secretion of gastric juice, improving appetite, and strengthening digestion. Since the draft beer must be stored and sold by special and complicated equipment, which limits is popularity and fails to enter into most of the household markets.

As the technology of draft beer containers advance, a common draft beer container generally includes a gas supply device (that supplies carbon dioxide) and a beer keg installed separately with each other, so that they are inconvenient to carry. Although Heineken has developed and introduced the Heineken 5 L Barrel to overcome the aforementioned drawback and maintain the quantity of the fresh keg beer to the best all to the last drop, yet the barrel cannot be used repeatedly, and such barrel is expensive and environmentally unfriendly. Furthermore, this barrel also comes with a carbon dioxide compression system (fixed to the barrel by adhesive) to supply carbon dioxide to be mixed with the beer, and thus consumers have doubts about their hygiene. Therefore, it is an important and urgent subject for related manufacturers to design a draft beer container to achieve the effects of overcoming the aforementioned insufficient beer packaging issue, lowering the cost, and providing premium fresh beer. When the draft beer flows out from the draft beer container, the liquid flow is generally fixed and cannot be controlled, and thus the use of the conventional draft beer container is very inconvenient.

SUMMARY OF THE INVENTION

Problem to be Solved

It is a primary objective of this disclosure to provide a dispenser with an alcohol throttle valve capable of adjusting the flow of beer or alcoholic beverage.

Technical Solution

To achieve the aforementioned and other objectives, this disclosure provides a dispenser with an alcohol throttle valve, comprising: a dispenser base, a head, an operation control device and throttle valve, characterized in that a head socket hole is formed at the center of the dispenser base and matched with and movably sheathed on the head; the operation control device is matched and coupled to the dispenser base and the head; the head is controlled by the operation control device to perform a head movement in the head socket hole of the dispenser base; and the throttle valve is matched and installed in the head, so that the throttle valve can adjust the liquid flow in the head.

Wherein, the head has a liquid inlet formed at the bottom of the head and communicated with the beer barrel for liquid flow, and a liquid outlet formed on a side of the head and matched with and coupled to an alcohol output pipe, a throttle valve mounting hole formed at the top of the head and matched with a throttle valve, and the throttle valve mounting hole has a bottom matched with and penetrating through the liquid inlet, and a side matched with and penetrating through the liquid outlet; and the throttle valve comprises a valve body matched with the throttle valve mounting hole, and a valve switch for controlling an up-and-down movement of the valve body; when the valve switch controls the valve body to move downwardly to seal and connect the valve body to the throttle valve mounting hole, the liquid inlet cannot pass through the throttle valve mounting hole to penetrate through the liquid outlet and seal an alcohol output passage inside the head; when the valve switch controls the valve body to move upwardly to the valve body and become gradually separated from the gap of the throttle valve mounting hole, the liquid inlet passes through the gap inside the throttle valve mounting hole and penetrates through the liquid outlet, so as to open the alcohol output passage inside the head.

Wherein, the valve body comprises a lower valve body with a tapered conical structure, and an upper valve body matched with and coaxially sheathed and fixed to the top of the lower valve body; and the throttle valve mounting hole has a bottom section designed as a conical hole matched with the conical structure of the lower valve body; and the valve switch is a knob switch, and the knob switch has a coaxial positioning engagement through hole formed at the middle thereof, and the top of the upper valve body has a positioning engagement bump coaxially and integrally coupled thereto and matched with the positioning engagement through hole, and the top of the positioning engagement bump has a thread fixing hole configured to be coaxially thereto; the knob switch is matched and engaged with the positioning engagement bump through the positioning engagement through hole, and a thread between the screw and the thread fixing hole is provided for linking and fixing the knob switch with the valve body; the knob switch and the top of the head are coupled by a thread, and the thread between the knob switch and the head is provided for adjusting an up-and-down movement of the linked valve body inside the throttle valve mounting hole.

Wherein, the throttle valve further comprises a valve body limiter, a through hole formed at the middle of the valve body limiter and configured to be coaxial with the valve body limiter, and the through hole has an internal hole diameter smaller than the maximum external diameter of the valve body, and the valve body limiter and the top of the head are detachably fixed to each other.

Wherein, the top of dispenser base has two perpendicular control rods, and the distances from the two control rods to the head socket hole along the axial line are equal; the operation control device comprises a U-shaped moving plate and a handle; two top ends of the U-shaped moving plate are matched with and hinged to the top ends of the two control rods by a bolt respectively, and the middle of an end of the U-shaped moving plate is matched with and coupled to the handle; inner walls of two side plates of the U-shaped moving plate have symmetric cylindrical blocks respectively; both sides of the top of the head have symmetric level slide slots, and the slide slot has a width matched with the cross-sectional diameter of the cylindrical block.

Wherein, the top of the dispenser base further has a vertical gear plate, and the gear plate is attached to an inner sidewall of an end of the U-shaped moving plate, and the gear plate is attached to a curved surface which is attached to the inner side wall of an end of the U-shaped moving plate and configured to be matched with the movement of the U-shaped moving plate; the handle comprises a fixed handle, a pole, a pole restoring spring and a movable handle; the fixed handle and the middle of an end of the U-shaped moving plate are integrally coupled to each other, and the fixed handle has a first sunken hole formed therein and penetrating from front to rear; the first sunken hole has a large opening penetrating through the middle of an end of the U-shaped moving plate; the pole sequentially comprises a coaxially and integrally coupled top head, a large cylindrical section matched with the large hole diameter of the first sunken hole and coupled to the first sunken hole, a small cylindrical section matched with the small hole diameter of the first sunken hole and coupled to the first sunken hole, and an end of the small cylindrical section has a clip spring slot; after penetrating through the first sunken hole, the pole passes through the gasket and the clip spring to fix the clip spring slot to an end of the fixed handle, and the gasket has an external diameter greater than the external diameter of the fixed handle; the pole restoring spring is installed between the bottom of the large hole of the first sunken hole and the large cylindrical section and matched with and coupled to the small cylindrical section; the movable handle has a second sunken hole formed therein and penetrating through the front and the rear, and the second sunken hole has a small hole diameter matched with the external diameter of the fixed handle, and the second sunken hole has a large hole diameter matched with the external diameter of the gasket; the curved surface sequentially arranged from top to bottom has a first gear slot matched with the top head, a second gear slot and a third gear slot.

Wherein, the curved gusset and the pin component are disposed at the bottom of the dispenser base; a curved engagement slot is formed at the curved gusset and matched with and coupled to a ring-shaped step disposed on the top side of the beer spear; and the curved engagement slot has a curved surface extending side tangent to the bottom side of the pin component.

Wherein, the pin component comprises a pin holder, a pin, a restoring spring and a handle; the pin holder is integrally coupled to the bottom side of the dispenser base, and the pin holder has a handle hole, a pin hole and a spring hole sequentially, vertically, and coaxially penetrating through the top surface of the pin holder; the pin hole has a hole diameter smaller than the hole diameter of the handle hole, and the pin hole has a hole diameter smaller than the hole diameter of the spring hole; the handle is matched with and plugged into the handle hole, and the pin is matched with and plugged into the pin hole, and the top of the pin and the bottom of the handle are matched with and coupled to each other; the pin has a protruding ring disposed at the bottom side of the pin and matched with the spring hole, and the restoring spring is installed between the bottom of the spring hole and the protruding ring and matched with and coupled to the pin; the curved surface extending side of the curved engagement slot is tangent to the bottom side of the pin.

Wherein, the handle has a rectangular cross-section, and the cross-section of the handle hole is matched with the handle.

Wherein, the axis of the curved engagement slot and the axis of the head are on the same axial line.

Beneficial Effects

In summation, this disclosure has the following advantageous effects:

Compared with the prior art, this disclosure has the throttle valve installed in the head for controlling the connection and disconnection between the liquid outlet and the liquid inlet in the head to achieve the effect of controlling the liquid flow in the head, so that the dispenser of this disclosure has the effects of controlling the alcohol output flow, and facilitating users to adjust the alcohol output flow according to actual needs. Wherein, the valve switch of the throttle valve is a knob switch provided for opening and closing the throttle valve, which has the features of simple structure and convenient operation. With the installation of the valve body limiter, the valve body will not be pulled out completely with the valve switch, so as to prevent alcohol from flowing out from the throttle valve mounting hole effectively.

This disclosure will become clearer in light of the following detailed description of an illustrative embodiment of this disclosure described in connection with the drawings, so that people having ordinary skill in the art can implement this disclosure according to the description of this specification.

DESCRIPTION OF THE PREFERRED EMBODIMENTS

To make it easier for our examiner to understand the objective of the disclosure, its structure, innovative features, and performance, we use a preferred embodiment together with the attached drawings for the detailed description of the disclosure.

Figure 1:
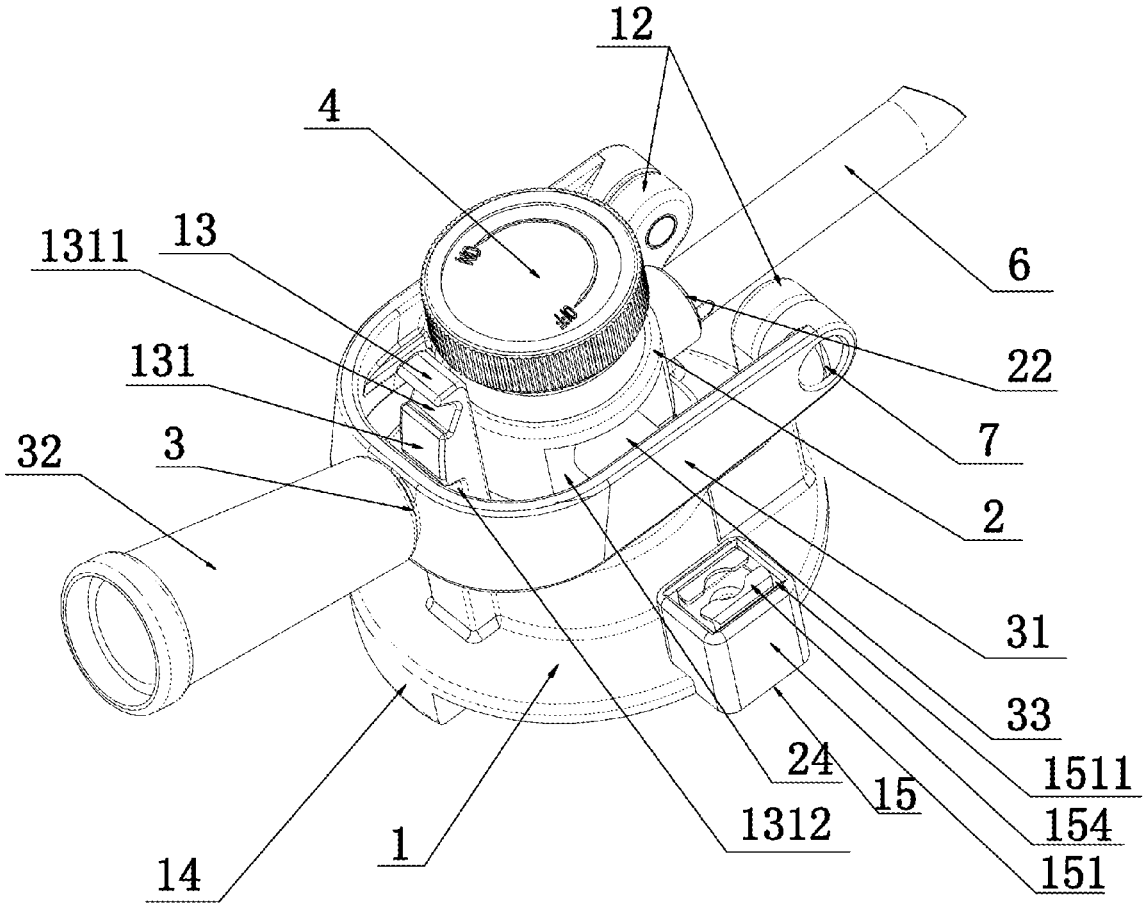
FIG. 1 is a perspective top view of an alcohol throttle valve of this disclosure.
Figure 2:
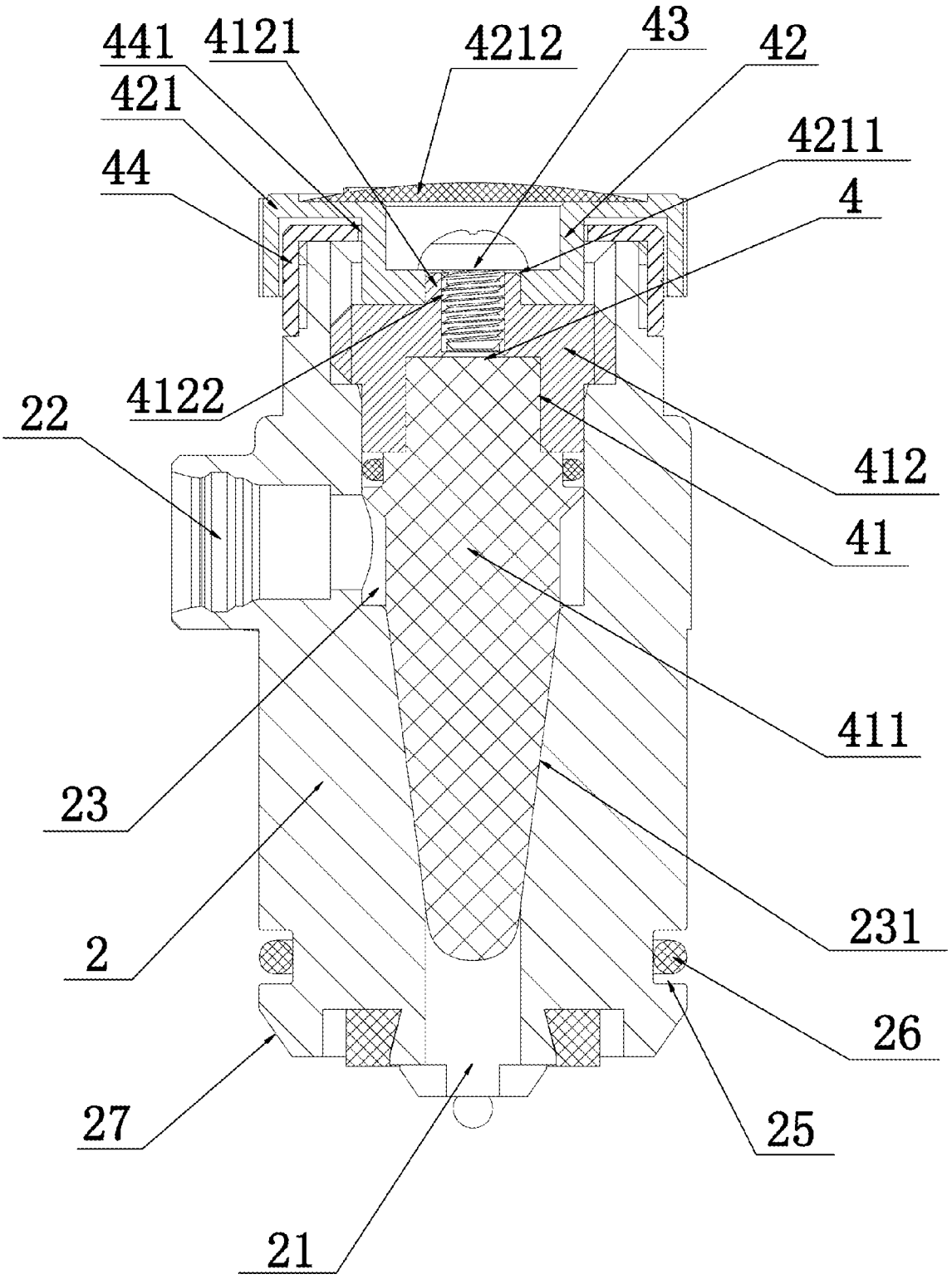
FIG. 2 is a schematic view of a head with a throttle valve of this disclosure.
Figure 3:
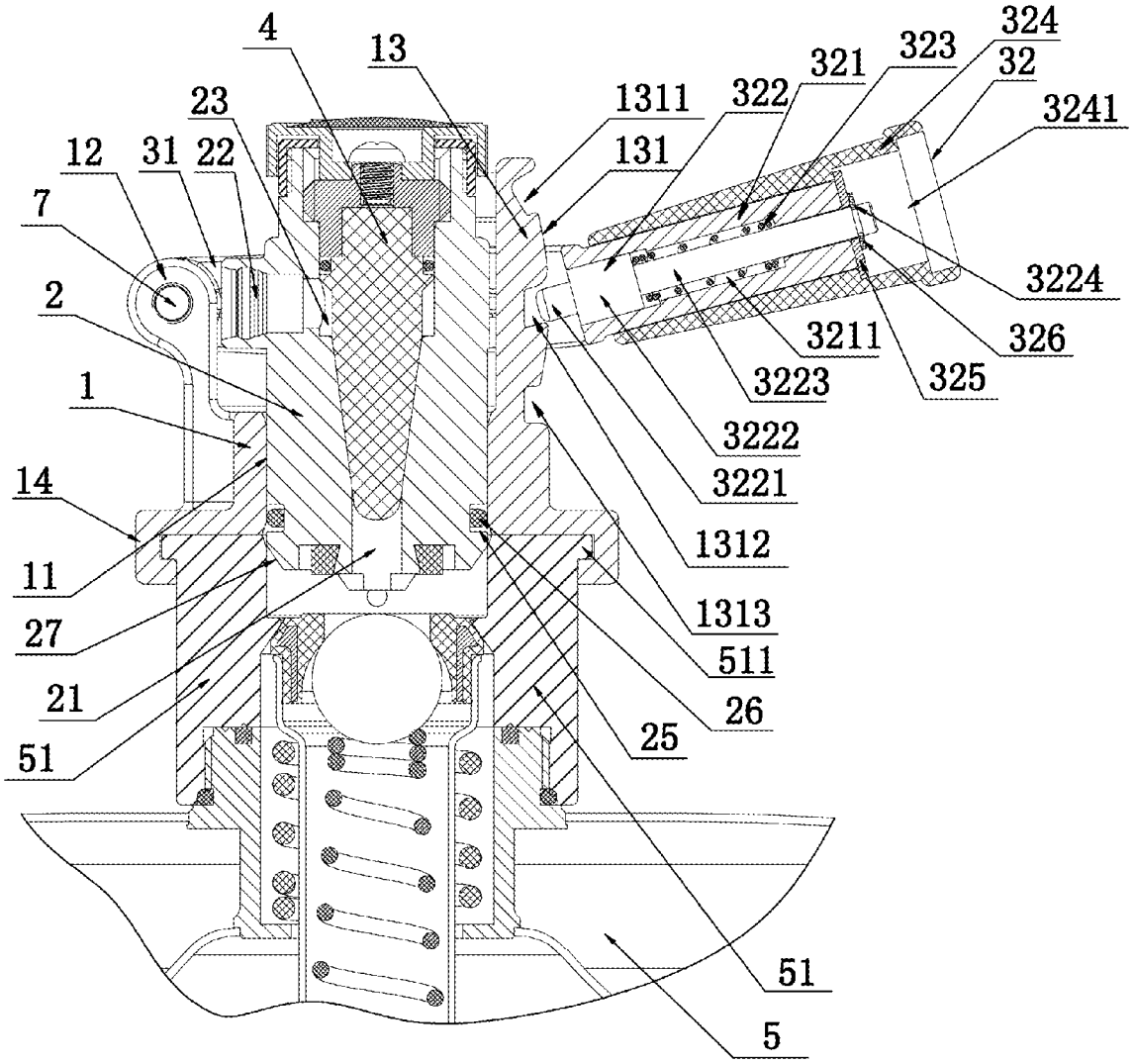
FIG. 3 is a cross-sectional view of an operation control device of a dispenser connected to a beer barrel in accordance with this disclosure.
Figure 4:
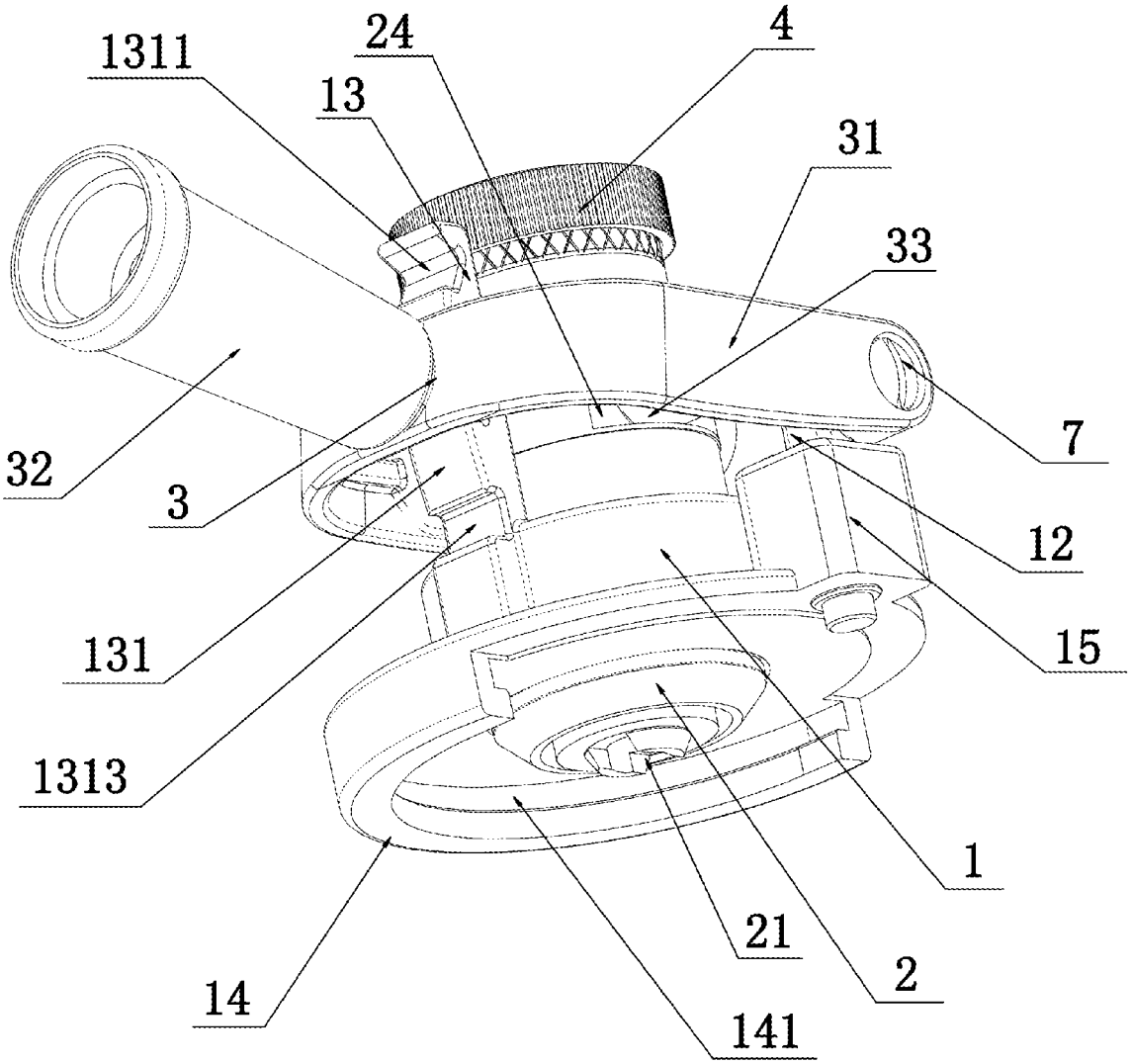
FIG. 4 is a perspective bottom view of a dispenser with an alcohol throttle valve of this disclosure.
Figure 5:
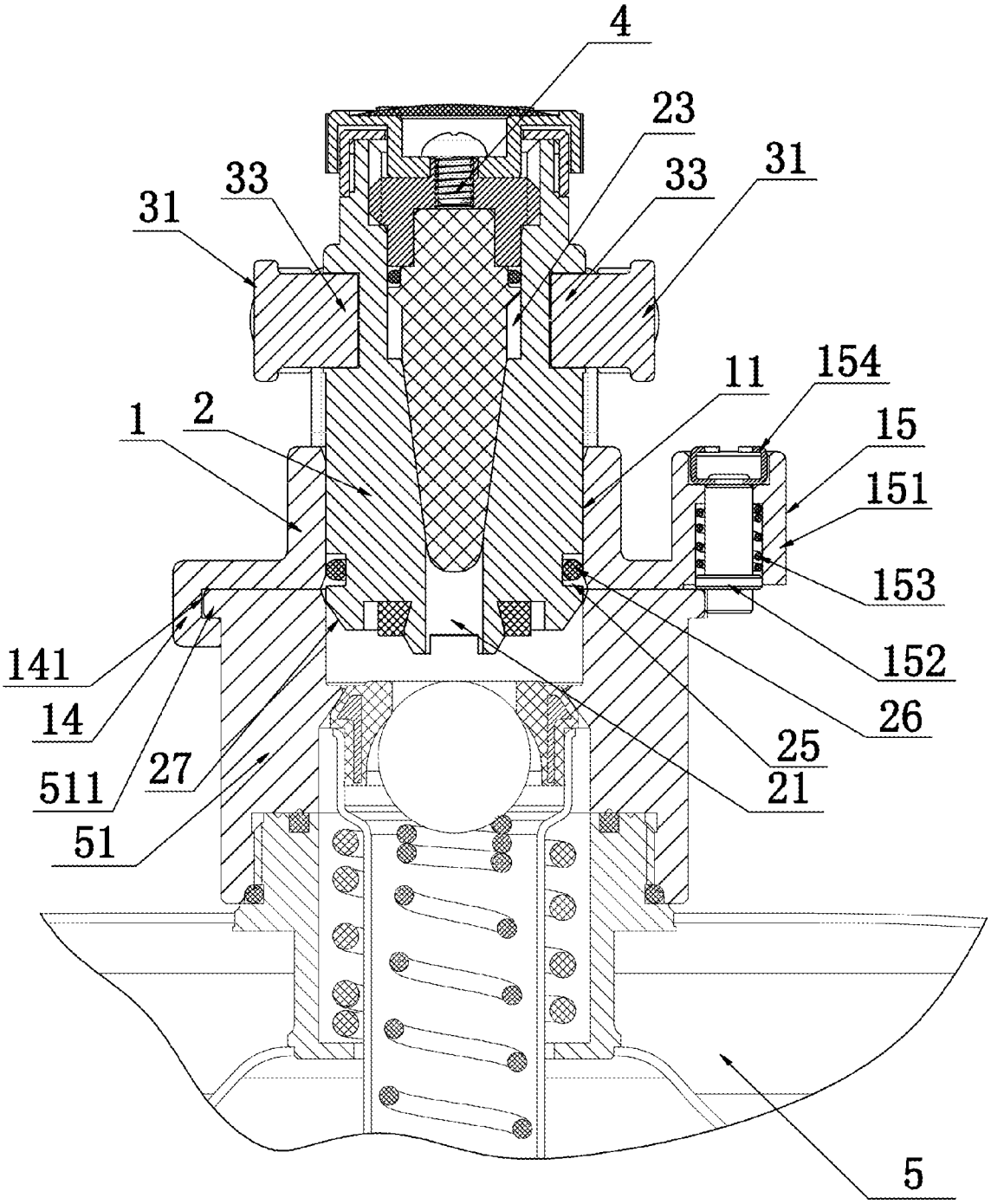
FIG. 5 is a cross-sectional view showing a connection structure between a dispenser and a beer barrel of this disclosure.
Figure 6:
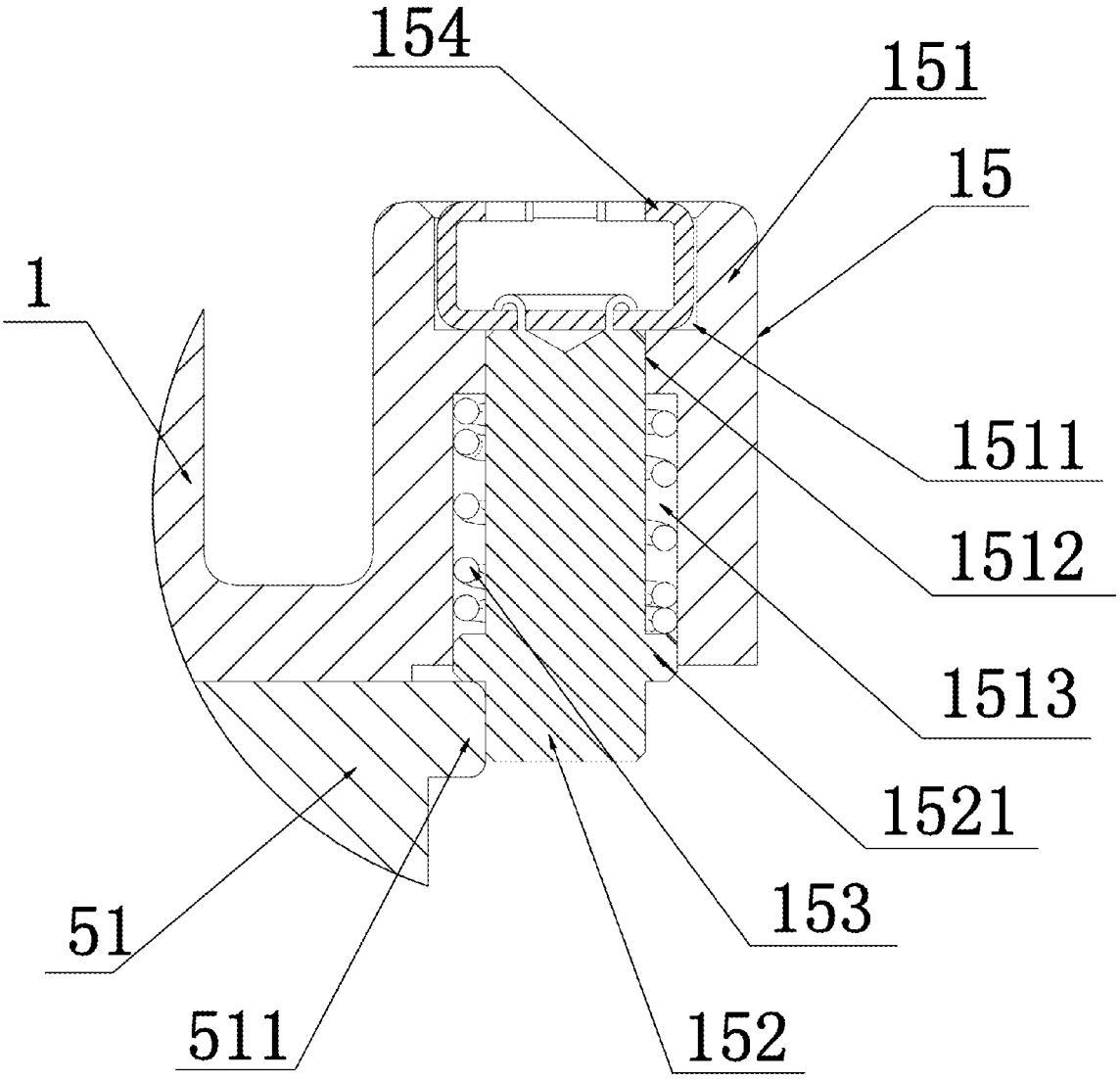
FIG. 6 is a blowup view of a pin of this disclosure.

FIG. 1 is a perspective top view of an alcohol throttle valve of this disclosure, showing a dispenser of this disclosure comprising a dispenser base 1, a head 2, an operation control device 3 and a throttle valve 4 and their connection relation. FIG. 2 is a schematic view of a head with a throttle valve of this disclosure, mainly showing a throttle valve 4 comprised of a valve body 41, a valve switch 42, a screw 43 and a valve body limiter 44 and their connection relation. FIG. 3 is a cross-sectional view of an operation control device of a dispenser connected to a beer barrel in accordance with this disclosure, wherein a connection structure between the dispenser base 1 and the head 2 is emphasized, and three gear position control structures of the operation control device 3 are shown. FIG. 4 is a perspective bottom view of a dispenser with an alcohol throttle valve of this disclosure, wherein the curved gusset 14 and the pin component 15 at the bottom of the dispenser base 1 are emphasized. FIG. 5 a cross-sectional view showing a connection structure between the dispenser and the beer barrel of this disclosure, wherein the dispenser base 1 is a connection structure capable of having a 360-degree free rotation on the beer spear 51. FIG. 6 is a blowup view of a pin of this disclosure, wherein a pin component 22 is formed by a pin holder 221, a pin 222, a restoring spring 223 and a handle 224.

In the structure of the dispenser with an alcohol throttle valve of this disclosure as shown in FIGS. 1 and 4, the dispenser comprises a dispenser base 1, a head 2, an operation control device 3 and a throttle valve 4. A head socket hole 11 is formed at the center of the dispenser base 1 and matched with and movably sheathed on the head 2; the operation control device 3 is matched and coupled to the dispenser base 1 and the head 2; the head 2 is controlled by the operation control device 3 to perform a head movement in the head socket hole 11 of the dispenser base 1; and the throttle valve 4 is matched and installed in the head 2, so that the throttle valve 4 can adjust the liquid flow in the head 2. In the aforementioned structure of this disclosure, the throttle valve 4 used to control the connection and disconnection of the liquid flow in the head 2, so that this dispenser has the function of controlling the liquid flow of the alcohol output to facilitate users to adjust the alcohol output floor according to actual requirement.

In this embodiment as shown in FIGS. 1, 2 and 3, the head 2 has a liquid inlet 21 formed at the bottom of the head 2 and communicated with the beer barrel 5 for liquid flow, and a liquid outlet 22 formed on a side of the head 2 and matched with and coupled to an alcohol output pipe 6, a throttle valve mounting hole 23 formed at the top of the head 2 and matched with a throttle valve 4, and the throttle valve mounting hole 23 has a bottom matched with and penetrating through the liquid inlet 21, and a side matched with and penetrating through the liquid outlet 22; and the throttle valve 4 comprises a valve body 41 matched with the throttle valve mounting hole 23, and a valve switch 42 for controlling an up-and-down movement of the valve body 41; when the valve switch 42 controls the valve body 41 to move downwardly to seal and connect the valve body 41 to the throttle valve mounting hole 23, the liquid inlet 21 cannot pass through the throttle valve mounting hole 23 to penetrate through the liquid outlet 22 and seal an alcohol output passage inside the head 2; when the valve switch 42 controls the valve body 41 to move upwardly to the valve body 41 and become gradually separated from the gap of the throttle valve mounting hole 23, the liquid inlet 21 passes through the gap inside the throttle valve mounting hole 23 and penetrates through the liquid outlet 22, so as to open the alcohol output passage inside the head 2. In addition, the size of the gap between the valve body 41 and the throttle valve mounting hole 23 can be used to control the liquid flow inside the head 2, so that the valve switch 42 can be used to adjust the liquid flow of the head 2.

In this embodiment as shown in FIG. 2, the valve body 41 comprises a lower valve body 411 with a tapered conical structure, and an upper valve body 412 matched with and coaxially sheathed and fixed to the top of the lower valve body 411, wherein, the upper valve body 411 is made of stainless steel to guarantee the rigidity of the valve body 41 during the up-and-down movement, and the lower valve body 412 is made of plastic to guarantee a specific hardness and a good sealing function; the metallic upper valve body 411 is used as an insert, and when the lower valve body 412 is formed by resin injection molding, the upper valve body 411 is wrapped to form an integral valve body 41; the throttle valve mounting hole 23 has a bottom section designed as a conical hole 231 matched with the conical structure of the lower valve body 411; wherein, an even gap is formed between the lower valve body 411 and the conical hole 231, and a liquid obtained during the alcohol output process flows from the smallest ring gap to the largest ring gap, so that the draft beer flows stably through the ring gaps in a laminar flow state to achieve the effect of releasing the pressure and retarding the flow of the draft beer to guarantee that the draft beer can be outputted slowly and smoothly and to prevent the draft beer from flowing too quickly, irregularly, or badly and avoid foam splash caused by a quick flow of draft beer; the valve switch 42 is a knob switch 421, and the knob switch 421 has a coaxial positioning engagement through hole 4211 formed at the middle thereof; wherein the positioning engagement through hole 4211 is a non-circular through hole such as a rectangular hole, a square hole, an elliptical hole, a curved hole, etc. to guarantee the knob switch 421 to be linked with the valve body 41 during the rotation; the top of the upper valve body 412 has a positioning engagement bump 4121 coaxially and integrally coupled thereto and matched with the positioning engagement through hole 4211, and the top of the positioning engagement bump 4121 has a thread fixing hole 4122 configured to be coaxially thereto; wherein, the positioning engagement bump 4121 has a height smaller than or equal to the depth of the positioning engagement through hole 4211 to guarantee that there is no up-and-down movement between the knob switch 421 and the valve body 41; the knob switch 421 is matched and engaged with the positioning engagement bump 4121 through the positioning engagement through hole 4211, and a thread between the screw 43 and the thread fixing hole 4122 is provided for linking and fixing the knob switch 421 with the valve body 41; wherein, the bottom of the nut of the screw 43 covers a part of the top of the knob switch 421 to guarantee a secured connection between the knob switch 421 and the valve body 41; the knob switch 421 and the top of the head 2 are coupled by a thread, and the thread between the knob switch 421 and the head 2 is provided for adjusting an up-and-down movement of the linked valve body 41 inside the throttle valve mounting hole 23. In this disclosure, the knob switch 421 used to achieve the effect of controlling the up-and-down movement of the valve body 41 has the advantages of simple structure and convenient operation. Wherein, the top of the knob switch 421 has an indicator cover 4212 that covers the screw 43, and the top of the indicator cover 4212 has words and their corresponding rotation arrows related to the switch, so that the indicator cover 4212 has the functions of protecting the screw 43 and giving a direct hint of the functions of the switch. In addition, an O-ring is installed between the valve body 41 and the throttle valve mounting hole 23 and disposed at the top of the liquid outlet 22 to guarantee a good sealing function and prevent alcohol or beer from leaking through the throttle valve mounting hole 23 to the outside.

In this embodiment as shown in FIG. 2, the throttle valve 4 further comprises a valve body limiter 44, a through hole 441 formed at the middle of the valve body limiter 44 and configured to be coaxial with the valve body limiter 44, and the through hole 441 has an internal hole diameter smaller than the maximum external diameter of the valve body 1, and the valve body limiter 44 and the top of the head 2 are detachably fixed to each other; for example, they are detachably fixed to each other by a thread or by a snap connection structure. In this disclosure, the valve body limiter can prevent the valve body 41 from separating from the throttle valve mounting hole 23 effectively, so as to prevent alcohol from flowing out from the throttle valve mounting hole 23. Wherein, the knob switch 421 can be coupled to the valve body limiter 44 through the thread, and the connection through the thread gives the effect of adjusting the up-and-down movement of the valve body 41. In addition, the knob switch 421 may be rotatably coupled to the valve body limiter 44 or the top of the head 4; when the valve body 41 is driven by the knob switch 421 to press and block the throttle valve mounting hole 23, the rotatable connection keeps the liquid inlet 21 and the liquid outlet 22 away from the penetrating state; when the knob switch 421 is released from the rotatable connection state, the knob switch 421 may be lifted upward to drive the valve body 41 to move upwardly, so as to release the sealing and blocking between the valve body 41 and the flow valve mounting hole 23. As a result, the liquid inlet 21 and the liquid outlet 22 and be communicated with each other through the flow valve mounting hole 23 to achieve the alcohol output effect at the head 2.

In this embodiment as shown in FIGS. 1, 3 and 4, the top of the dispenser base 1 has two vertical control rods 12, and the distances from the two control rods 12 to the axial line of the head socket hole 11 are equal; the operation control device 3 comprises a U-shaped moving plate 31 and a handle 32; two top ends of the U-shaped moving plate 31 are matched with and hinged to the top ends of the two control rods 12 by a bolt 7 respectively, and the middle of an end of the U-shaped moving plate 31 is matched with and coupled to the handle 32; inner walls of two side plates of the U-shaped moving plate 31 have symmetric cylindrical blocks 33 respectively; both sides of the top of the head 2 have symmetric level slide slots 24, and the slide slot 24 has a width matched with the cross-sectional diameter of the cylindrical block 33. This disclosure uses the operation device to drive the head for an up-and-down movement, so as to control the gas path and the liquid path in the beer barrel.

In this embodiment as shown in FIGS. 1 and 3, the top of the dispenser base 1 further has a vertical gear plate 13, and the gear plate 13 is attached to an inner sidewall of an end of the U-shaped moving plate 31, and the gear plate 13 is attached to a curved surface 131 which is attached to the inner side wall of an end of the U-shaped moving plate 31 and configured to be matched with the movement of the U-shaped moving plate 31; the handle 32 comprises a fixed handle 321, a pole 322, a pole restoring spring 323 and a movable handle 324; the fixed handle 321 and the middle of an end of the U-shaped moving plate 31 are integrally coupled to each other, and the fixed handle 321 has a first sunken hole 3211 formed therein and penetrating from front to rear; the first sunken hole 3211 has a large opening penetrating through the middle of an end of the U-shaped moving plate 31; the pole 322 sequentially comprises a coaxially and integrally coupled top head 3221, a large cylindrical section 3222 matched with the large hole diameter of the first sunken hole 3211 and coupled to the first sunken hole 3211, a small cylindrical section 3223 matched with the small hole diameter of the first sunken hole 3211 and coupled to the first sunken hole 3211, and an end of the small cylindrical section 3223 has a clip spring slot 3224; after penetrating through the first sunken hole 3211, the pole 322 passes through the gasket 325 and the clip spring 326 to fix the clip spring slot 3224 to an end of the fixed handle 321, and the gasket 325 has an external diameter greater than the external diameter of the fixed handle 321; the pole restoring spring 323 is installed between the bottom of the large hole of the first sunken hole 3211 and the large cylindrical section 3222 and matched with and coupled to the small cylindrical section 3223; the movable handle 324 has a second sunken hole 3241 formed therein and penetrating through the front and the rear, and the second sunken hole 3241 has a small hole diameter matched with the external diameter of the fixed handle 321, and the second sunken hole 3241 has a large hole diameter matched with the external diameter of the gasket 325; the curved surface 131 sequentially arranged from top to bottom has a first gear slot 1311 matched with the top head 3221, a second gear slot 1312 and a third gear slot 1313.

When the operation control device 3 of this product is used, a user holds and pulls the movable handle 324 backward by hand, so that the gasket 325 abuts at the bottom of the large hole of the second sunken hole 3241 to drive the pole 322 to overcome the resilience force of the pole restoring spring 323 and move backward, so that the top head 3221 of the pole 322 retracted into the first sunken hole 3211; and then the up-and-down movement of the handle 32 is controlled to drive the head 2 to perform the up-and-down movement. When the front end of the handle 32 is aligned precisely with any one gear slot formed on the curved surface 131 of the gear plate 13, the handle is opened, so that the top head 3221 of the pole 322 is snapped into the aligned gear slot under the effect of the resilience force of the pole restoring spring 323, so as to fix the operation device to its position. When the top head 3221 is snapped into the first gear slot 1311, it is belong in a neutral state, and the head 2 has not propped to open the gas path and liquid path, so that the draft beer fresh-keeping barrel remains at the storage state; when the top head 3221 is snapped into the second gear slot 1312, the head 2 props to open the gas path but not the liquid path, so that the carbon dioxide gas in the draft beer fresh-keeping barrel enters into the beer spear 51; when the top head 3221 is snapped into the third gear slot 1313, the head 2 props to open both gas path and liquid path, so that the carbon dioxide gas enters into the storage chamber of the beer barrel 5 to compress the draft beer to flow through the beer spear 51 and enter into the liquid inlet 21 of the head and flows from the liquid outlet 22 into the alcohol output pipe 6.

In this embodiment as shown in FIG. 3, the outer side of the bottom of the head 2 has an O-ring installation slot 25 coaxial thereto, and the O-ring installation slot 25 is matched with an O-ring 26. In this disclosure, the O-ring can effectively seal the exit of the beer spear 51 at the top of the beer barrel 5 to prevent gas from entering from the head and leaking from the exit at the top of the beer spear 51, so as to improve the gas sealing function.

In this embodiment as shown in FIG. 3, the outer periphery of the bottom of the head 2 has a chamfer 27 for guiding the head to smoothly enter into the exit at the top of the beer spear 51 to guarantee a smooth up-and-down movement of the head 2.

In this embodiment as shown in FIG. 3, the liquid inlet 21 is vertically formed and configured to be coaxial to the head 2; the liquid outlet 22 is formed on a side of the top section of the head 2 and disposed between two parallel operation rods 12; the liquid outlet 22 and the liquid inlet 21 are vertically communicated with each other in the head 2, so that the draft beer in the beer barrel enters from the liquid inlet of the head and flows out from the under the pressure of the carbon dioxide gas.

In this embodiment as shown in FIGS. 1, 4 and 5, the curved gusset 14 and the pin component 15 are disposed at the bottom of the dispenser base 1; a curved engagement slot 141 is formed at the curved gusset 14 and matched with and coupled to a ring-shaped step 511 disposed on the top side of the beer spear 51; and the curved engagement slot 141 has a curved surface extending side tangent to the bottom side of the pin component 15. In the aforementioned structure of this disclosure, when the dispenser and the beer spear are assembled, the bottom surface of the dispenser without the curved gusset is contacted with the top of the beer spear, and the dispenser is pushed sideway to engage the curved engagement slot with the ring-shaped step and then a pin component is latched to a side of the ring-shaped step, and such connection method allows the dispenser to be able to have a 360-degree free rotation with respect to the beer spear, so that the alcohol output direction can be adjusted freely, and this method has the advantages of simple structure and flexible and convenient operation.

In this embodiment as shown in FIGS. 5 and 6, the pin component 15 comprises a pin holder 151, a pin 152, a restoring spring 153 and a handle 154; the pin holder 151 is integrally coupled to the bottom side of the dispenser base 1, and the pin holder 151 has a handle hole 1511, a pin hole 1512 and a spring hole 1513 sequentially, vertically, and coaxially penetrating through the top surface of the pin holder 151; the pin hole 1512 has a hole diameter smaller than the hole diameter of the handle hole 1511, and the pin hole 1512 has a hole diameter smaller than the hole diameter of the spring hole 1513; the handle 154 is matched with and plugged into the handle hole 1511, and the pin 152 is matched with and plugged into the pin hole 1512, and the top of the pin and the bottom of the handle 154 are matched with and coupled to each other; the pin 152 has a protruding ring 1521 disposed at the bottom side of the pin 152 and matched with the spring hole 1513, and the restoring spring 153 is installed between the bottom of the spring hole 1513 and the protruding ring 1521 and matched with and coupled to the pin 152; the curved surface extending side of the curved engagement slot 141 is tangent to the bottom side of the pin 152. In this disclosure, the pin adopts the aforementioned structure, so that when the dispenser and the beer spear are connected to each other, the handle is lifted up to let the bottom of the pin be higher than the bottom of the dispenser; when the curved engagement slot is engaged with the ring-shaped step, the handle is released, so that the pin will be latched to a side of the ring-shaped step automatically under the reliance force of the restoring spring, so as to achieve the effect of connecting the dispenser with the beer spear.

In this embodiment as shown in FIG. 1, the handle 154 has a rectangular cross-section, and the handle hole 1511 has a cross-section matched with that of the handle 154. In this disclosure, the handle 154 adopts the aforementioned structure, so that when the handle 154 is lifted up, it can be latched to the top of the pin holder simply by rotating a specific angle, so as to prevent the pin from resuming its original position under the action force of the restoring spring.

In this embodiment as shown in FIG. 5, the axis of the ring-shaped step 511 and the axis of the curved engagement slot 141 have the same axial line with the axis of the head 2 of the dispenser, so as to guarantee a smooth operation of the piston during the 360-degree free rotation of the dispenser and prevent the piston from being bias.

In this embodiment, the curved engagement slot 141 has an arc angle smaller than 180 degrees to guarantee that the curved engagement slot can slide smoothly and engage with the ring-shaped step.

In this embodiment, the curved engagement slot 141 has an arc angle equal to 180 degrees, so that half of the ring-shaped step is engaged with the curved engagement slot to guarantee a maximum engagement area to improve the connecting strength.

In this embodiment, the tangent point of the pin component 15 and the curved surface of the curved engagement slot 141, and the center point and the axial line of the curved engagement slot 141 are on the same vertical plane, so that the connecting force of the pin and the curved engagement slot with the ring-shaped step is even to guarantee a good connecting strength.

While this disclosure has been described by means of specific embodiments, numerous modifications and variations could be made thereto by those skilled in the art without departing from the scope and spirit of the disclosure set forth in the claims.

What is claimed is:

1. A dispenser with an alcohol throttle valve, comprising a dispenser base, a head, an operation control device and a throttle valve, characterized in that a head socket hole is formed at the center of the dispenser base and matched with and movably sheathed on the head; the operation control device is matched and coupled to the dispenser base and the head; the head is controlled by the operation control device to perform a head movement in the head socket hole of the dispenser base; and the throttle valve is matched and installed in the head, so that the throttle valve can adjust the liquid flow in the head; wherein the head has a liquid inlet formed at the bottom of the head and communicated with a beer barrel for liquid flow, and a liquid outlet formed on a side of the head and matched with and coupled to an alcohol output pipe, a throttle valve mounting hole formed at the top of the head and matched with a throttle valve, and the throttle valve mounting hole has a bottom matched with and penetrating through the liquid inlet, and a side matched with and penetrating through the liquid outlet and the throttle valve comprises a valve body matched with the throttle valve mounting hole, and a valve switch for controlling an up-and-down movement of the valve body; when the valve switch controls the valve body to move downwardly to seal and connect the valve body to the throttle valve mounting hole, the liquid inlet cannot pass through the throttle valve mounting hole to penetrate through the liquid outlet and seal an alcohol output passage inside the head; when the valve switch controls the valve body to move upwardly to the valve body and become gradually separated from a gap of the throttle valve mounting hole, the liquid inlet passes through the gap inside the throttle valve mounting hole and penetrates through the liquid outlet, so as to open the alcohol output passage inside the head.

2. The dispenser with an alcohol throttle valve as claimed in claim 1, wherein the valve body comprises a lower valve body with a tapered conical structure, and an upper valve body matched with and coaxially sheathed and fixed to the top of the lower valve body; and the throttle valve mounting hole has a bottom section designed as a conical hole matched with the conical structure of the lower valve body; and the valve switch is a knob switch, and the knob switch has a coaxial positioning engagement through hole formed at the middle thereof, and the top of the upper valve body has a positioning engagement bump coaxially and integrally coupled thereto and matched with the positioning engagement through hole, and the top of the positioning engagement bump has a thread fixing hole configured to be coaxially thereto; the knob switch is matched and engaged with the positioning engagement bump through the positioning engagement through hole, and a thread between the screw and the thread fixing hole is provided for linking and fixing the knob switch with the valve body; the knob switch and the top of the head are coupled by a thread, and the thread between the knob switch and the head is provided for adjusting an up-and-down movement of the linked valve body inside the throttle valve mounting hole.

3. The dispenser with an alcohol throttle valve as claimed in claim 2, wherein the throttle valve further comprises a valve body limiter, a through hole formed at the middle of the valve body limiter and configured to be coaxial with the valve body limiter, and the through hole has an internal hole diameter smaller than the maximum external diameter of the valve body, and the valve body limiter and the top of the head are detachably fixed to each other.

4. A dispenser with an alcohol throttle valve, comprising a dispenser base, a head, an operation control device and a throttle valve, characterized in that a head socket hole is formed at the center of the dispenser base and matched with and movably sheathed on the head; the operation control device is matched and coupled to the dispenser base and the head; the head is controlled by the operation control device to perform a head movement in the head socket hole of the dispenser base; and the throttle valve is matched and installed in the head, so that the throttle valve can adjust the liquid flow in the head; wherein the top of the dispenser base has two perpendicular control rods, and the distances from the two control rods to the head socket hole along the axial line are equal; the operation control device comprises a U-shaped moving plate and a handle; two top ends of the U-shaped moving plate are matched with and hinged to the top ends of the two control rods by a bolt respectively, and the middle of an end of the U-shaped moving plate is matched with and coupled to the handle; inner walls of two side plates of the U-shaped moving plate have symmetric cylindrical blocks respectively; both sides of the top of the head have symmetric level slide slots, and the slide slot has a width matched with the cross-sectional diameter of the cylindrical block.

5. The dispenser with an alcohol throttle valve as claimed in claim 4, wherein the top of the dispenser base further has a vertical gear plate, and the gear plate is attached to an inner sidewall of an end of the U-shaped moving plate, and the gear plate is attached to a curved surface which is attached to the inner side wall of an end of the U-shaped moving plate and configured to be matched with the movement of the U-shaped moving plate; the handle comprises a fixed handle, a pole, a pole restoring spring and a movable handle; the fixed handle and the middle of an end of the U-shaped moving plate are integrally coupled to each other, and the fixed handle has a first sunken hole formed therein and penetrating from front to rear; the first sunken hole has a large opening penetrating through the middle of an end of the U-shaped moving plate; the pole sequentially comprises a coaxially and integrally coupled top head, a large cylindrical section matched with the large hole diameter of the first sunken hole and coupled to the first sunken hole, a small cylindrical section matched with the small hole diameter of the first sunken hole and coupled to the first sunken hole, and an end of the small cylindrical section has a clip spring slot; after penetrating through the first sunken hole, the pole passes through the gasket and the clip spring to fix the clip spring slot to an end of the fixed handle, and the gasket has an external diameter greater than the external diameter of the fixed handle; the pole restoring spring is installed between the bottom of the large hole of the first sunken hole and the large cylindrical section and matched with and coupled to the small cylindrical section; the movable handle has a second sunken hole formed therein and penetrating through the front and the rear, and the second sunken hole has a small hole diameter matched with the external diameter of the fixed handle, and the second sunken hole has a large hole diameter matched with the external diameter of the gasket; the curved surface sequentially arranged from top to bottom has a first gear slot matched with the top head, a second gear slot and a third gear slot.

6. A dispenser with an alcohol throttle valve, comprising a dispenser base, a head, an operation control device and a throttle valve, characterized in that a head socket hole is formed at the center of the dispenser base and matched with and movably sheathed on the head; the operation control device is matched and coupled to the dispenser base and the head; the head is controlled by the operation control device to perform a head movement in the head socket hole of the dispenser base; and the throttle valve is matched and installed in the head, so that the throttle valve can adjust the liquid flow in the head; wherein a curved gusset and a pin component are disposed at the bottom of the dispenser base; a curved engagement slot is formed at the curved gusset and matched with and coupled to a ring-shaped step disposed on the top side of a beer spear; and the curved engagement slot has a curved surface extending side tangent to the bottom side of the pin component.

7. The dispenser with an alcohol throttle valve as claimed in claim 6, wherein the pin component comprises a pin holder, a pin, a restoring spring and a handle; the pin holder is integrally coupled to the bottom side of the dispenser base, and the pin holder has a handle hole, a pin hole and a spring hole sequentially, vertically, and coaxially penetrating through the top surface of the pin holder; the pin hole has a hole diameter smaller than the hole diameter of the handle hole, and the pin hole has a hole diameter smaller than the hole diameter of the spring hole; the handle is matched with and plugged into the handle hole, and the pin is matched with and plugged into the pin hole , and the top of the pin and the bottom of the handle are matched with and coupled to each other;

the pin has a protruding ring disposed at the bottom side of the pin and matched with the spring hole, and the restoring spring is installed between the bottom of the spring hole and the protruding ring and matched with and coupled to the pin; the curved surface extending side of the curved engagement slot is tangent to the bottom side of the pin.

8. The dispenser with an alcohol throttle valve as claimed in claim 7, wherein the handle has a rectangular cross-section, and the cross-section of the handle hole is matched with the handle.

9. The dispenser with an alcohol throttle valve as claimed in claim 6, wherein the axis of the curved engagement slot and the axis of the head are on the same axial line.

* * * * *